US005154627A

United States Patent [19]

Lee

[11] Patent Number: 5,154,627

[45] Date of Patent: Oct. 13, 1992

[54] ELECTRICAL CONNECTOR INSERTABLY FIXED WITH SIMPLIFIED METAL LATCHES

[76] Inventor: Chih-Ta Lee, c/o Hung Hsing Patent Service Center, P.O. Box 55-1670, Taipei (10477), Taiwan

[21] Appl. No.: 794,923

[22] Filed: Nov. 20, 1991

[51] Int. Cl.[5] ..... H01R 13/62

[52] U.S. Cl. ..... 439/326; 439/327

[58] Field of Search ..... 439/326-328, 439/629-637, 62, 65, 329

[56] References Cited

U.S. PATENT DOCUMENTS 4,995,825 2/1991 Korsunsky et al. ..... 439/326

5,004,429 4/1991 Yagi et al. ..... 439/326

5,013,257 5/1991 Korsunsky et al. ..... 439/326

*Primary Examiner*—David L. Pirlot

[57] ABSTRACT

An electrical connector includes at least a pair of metal latches inserted in two opposite end portions of the connector, each metal latch having an embedding root portion formed on a lower portion of the latch insertably fixed in each end portion of the connector so that a daughter printed circuit board may be resiliently clamped between the two metal latches fixed on the connector to be electrically connected with a mother printed circuit board secured under the electrical connector.

4 Claims, 2 Drawing Sheets

ELECTRICAL CONNECTOR INSERTABLY FIXED WITH SIMPLIFIED METAL LATCHES

BACKGROUND OF THE INVENTION

Recent developments of electrical connectors for use in connecting a daughter printed circuit board with a mother printed circuit board are aimed to disclose metal latches to substitute those connectors each connector integrally formed with latch members on a connector base to prolong the service life of the latches and connector, from which a damaged latch can be replaceable with a new one, rather than discarding a complete set of electrical connector for saving cost.

Korsunsky et al. disclosed an electronic module socket with resilient latch in their U.S. Pat. No. 4,995,825. However, their metal latch should be made to have an engaging configuration of U shape insertable in a pocket (40) of the housing, still causing a production complexity of the connector. Yagi et al. invented a metal latch for SIMM socket in their U.S. Pat. No. 5,004,429 which requires a housing engaging portion (58) formed on the latch to be engageable with a socket housing (12), thereby being unable to reduce a production cost of the connector.

The present inventor has found the drawbacks of the conventional electrical connectors and invented the present electrical connector insertably fixed with simplified metal latches.

SUMMARY OF THE INVENTION

The object of the present invention is to provide an electrical connector including at least a pair of metal latches inserted in two opposite end portions of the connector, each metal latch having an embedding root portion formed on a lower portion of the latch insertably fixed in each end portion of the connector so that a daughter printed circuit board may be resiliently clamped between the two metal latches fixed on the connector to be electrically connected with a mother printed circuit board secured under the electrical connector.

DETAILED DESCRIPTION

Figure 1:
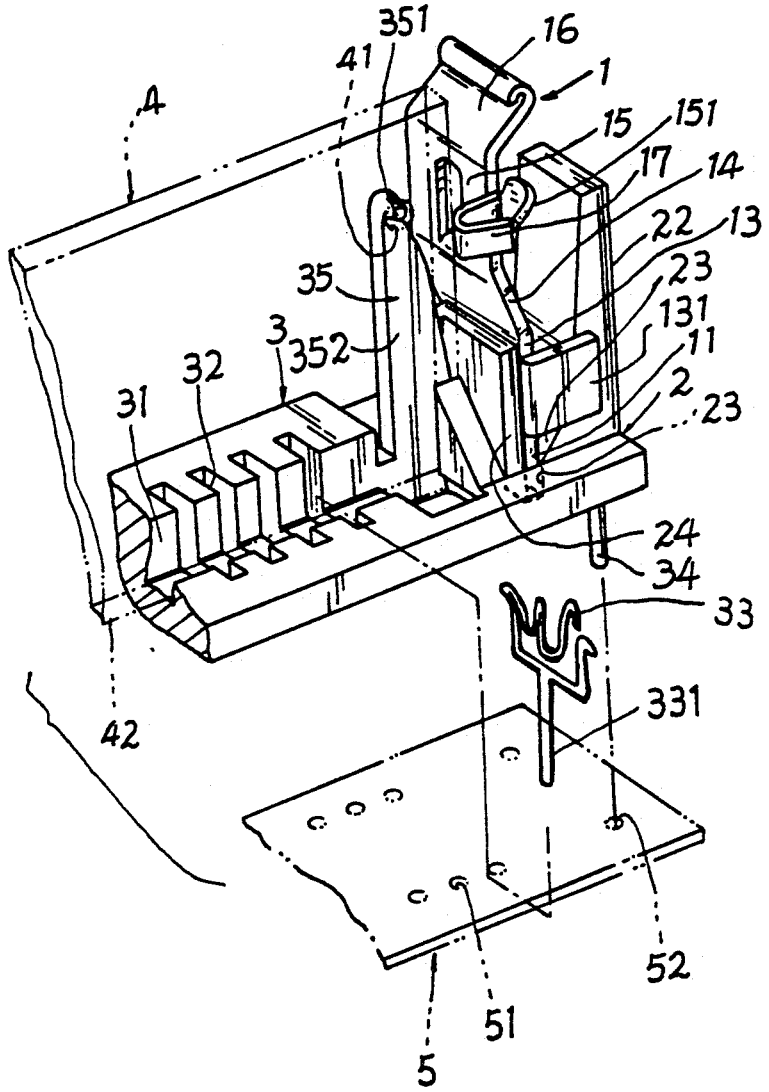
FIG. 1 is a perspective view of the present invention.
Figure 2:
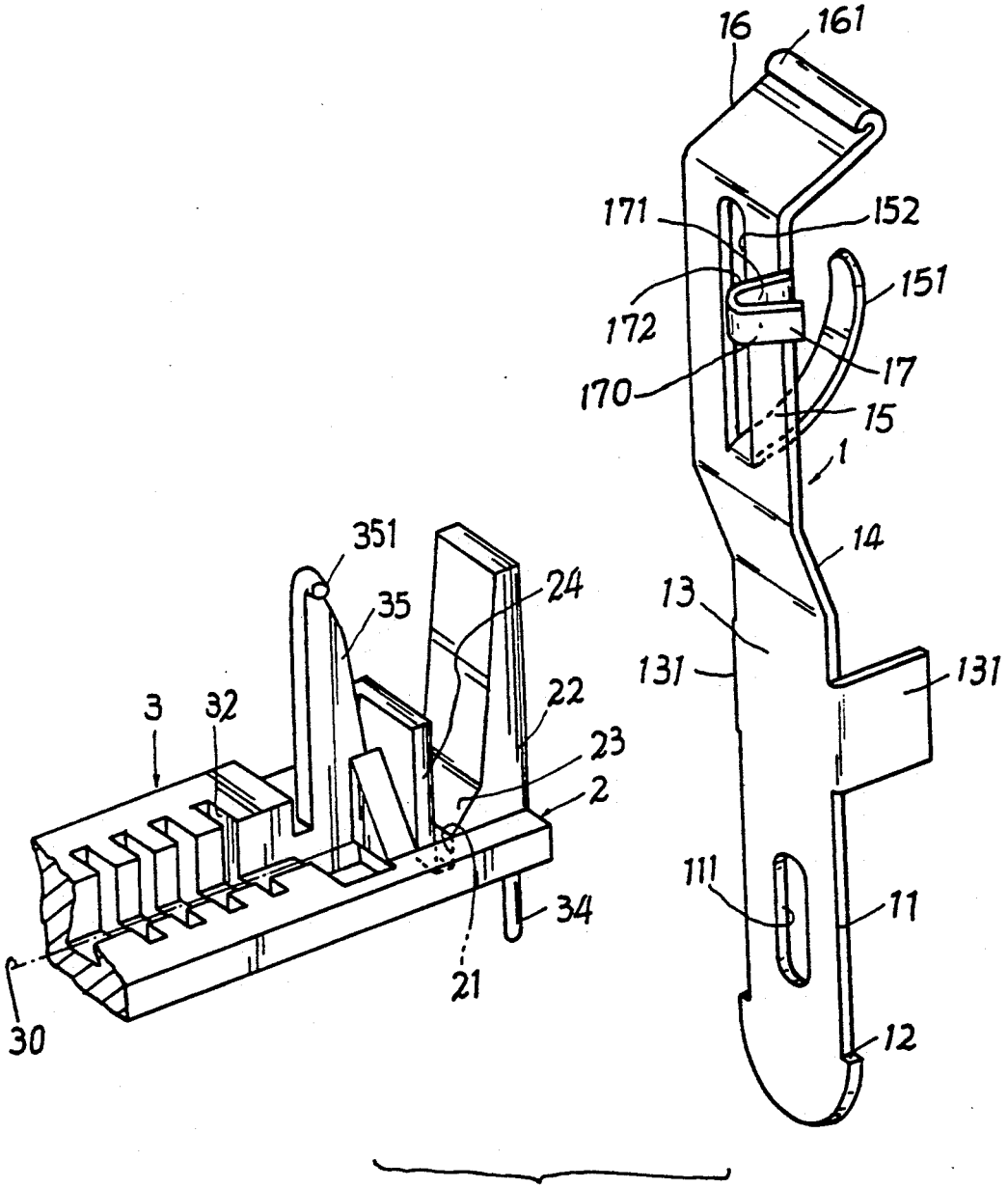
FIG. 2 is an illustration of a metal latch released from the electrical connector in accordance with the present invention.

As shown in FIGS. 1 and 2, the present invention comprises: an electrical connector 3 having a pair of metal latches 1 insertably fixed in two latch holding bases 2 respectively formed on two opposite end portions of the connector 3 for electrically connecting a daughter printed circuit board 4 inserted in the connector 3 with a mother printed circuit board 5 connected under the electrical connector 3.

The electrical connector 3 includes: a longitudinal socket 31 longitudinally formed in the connector 3, a plurality of contact slots 32 transversely formed in the connected 3 each slot 32 generally perpendicular to the longitudinal socket 31 or axis 30 for embedding a spring contact element 33 having a supporting leg member 331 protruding downwardly from the connector 3 to be inserted into a leg hole 51 formed in the mother board 5, two leg members 34 protruding downwardly from two opposite bottom end portions of the connector 3 to be engageable with two peg holes 52 formed on two opposite end portions of the mother board 5, and two stop members 35 formed on two opposite end portions of the connector each stop member 35 generally parallel to the longitudinal socket 31 having an alignment protrusion 351 formed on a top portion of each stop member.

Each alignment protrusion 351 of the stop member 35 is engageable with an opening 41 formed on each side portion of the daughter board 4 when the daughter board 4 is inserted in the socket 31 of the connector 3. The stop member 35 has a vertical surface portion 352 adjacent and parallel to the longitudinal socket 31 of the connector 3.

Each latch holding base 2 formed on each outer end portion of the connector 3 includes: a root hole 21 recessed in an outer end portion of the electrical connector 3, an outer retaining plate 22 and an inner retaining plate 24 respectively protruding upwardly from each holding base 2 and disposed on an inner and an outer side of the root hole 21 defining an aperture 23 between the two retaining plates 22, 24.

Each metal latch 1 fixed in each latch holding base 2 includes: an embedding root portion 12 formed on a lower latch portion 11 of the metal latch 1, a pair of wing portions 131 protruding outwardly from two opposite end portions of the metal latch to be generally perpendicular to a middle latch portion 13 above the lower latch portion 11 and slidably encompassing the outer retaining plate 22, an inwardly-bent portion 14 bending inwardly beyond the inner retaining plate 24, an upper latch portion 15 protruding upwardly from the inwardly-bent portion 14, a depression plate portion 16 formed on an uppermost portion of the upper latch portion 15 protruding outwardly upwardly from the upper latch portion 15, and a latching wedge portion 17 formed on an upper portion of the upper latch portion 15 below the depression plate portion 16 and tapered rearwardly and inwardly for slidably guiding a daughter board 4 to be resiliently clamped by the two metal latches 1 and stopped by the two stop members 35 respectively formed on two opposite end portions of the connector 3.

The latching wedge portion 17 has an acute angle 171 defined between a front wedge surface 170 of the wedge portion 17 and a rear vertical surface 172 which is generally perpendicular to the upper latch portion 15. When a daughter board 4 is clamped between the two latches 1, each end portion of the daughter board 4 is stably retained among the vertical surface portion 352 of the stop member 35, the upper latch portion 15, and the rear vertical surface 172 of the wedge portion 17.

The lower portion 11 of the metal latch 1 may be formed with a lower slot 111 and the embedding root portion 12 has a width slightly larger than a width of the lower latch portion 11 to be engageably fixed in the root hole 21 formed in the latch holding base 2.

The upper latch portion 15 of the metal latch is stamped to form a spring plate member 151 protruding outwardly from the upper latch portion 15 to be slidably retained on the outer retaining plate 22 of the latch holding base 2 and to form a spring-plate slot 152 in the upper latch portion 15.

The outer retaining plate 22 of the latch holding base 2 is higher than the inner retaining plate 24 protruding upwardly from the latch holding base 2 for limiting a metal latch 1 inserted in the root hole 21 of the latch holding base 2 between the outer and the inner retaining plates 22, 24.

The depression plate portion 16 is formed with a crimped edge portion 161 on an uppermost and outermost end portion of the depression plate portion 16 adapted to be depressed by an operator's fingers.

The crimped edge portion 161 may also be modified to be a simple bending portion or may be eliminated on the depression plate portion 16.

The lower latch portion 11 of the metal latch 1 may also be cut with a slit longitudinally slotted in a bottom portion of the lower latch portion 11.

When mounting the daughter board 4 onto the connector 3, the daughter board 4 may be first inclinedly inserted into the lower longitudinal socket 31 of the connector 3 to be clamped by the plurality of spring contact elements 33 embedded in the connector 3 and the daughter board 4 is slidably guided by the two wedge portions 17 of the two latches 1 to be stably retained within the two latches 1 and the two stop members 35. Therefore, the daughter board is firmly connected on the connector 3 and the conducting area 42 formed on the lower portion of the daughter board 4 is electrically connected with the plural contact elements 33 and finally connected with the mother board 5 secured under the connector 3 for finishing the eletrical connection between the two boards 4, 5. The latch 1 may be reciprocatively limited between the two retaining plates 2, 24, but normally resiliently biased inwardly as urged by the spring plate member 151 retained on the outer plate 22 for resiliently clamping the daughter board 4 between the two latches 1.

The present invention is superior to a conventional electrical connector provided with metal latches with the following advantages:

1. Just by simply inserting the latch 1 on the base 2 of the connector 3, the latch 1 can be fixed on the connector 3 quickly and conveniently.

2. A depression portion 16 is provided on an uppermost portion of each latch 1, which is easily depressed for resiliently ejecting a daughter board clamped by the spring contact elements 33 fixed in the connector 3 for facilitating a maintenance job for repairing or replacing the board 4 from the connector 3.

3. Both latch 1 and the connector 3 are simply constructed by eliminating complex elements such as a "pocket" having more side walls formed on the connector so as to greatly reduce the production and installation cost of the connector.

The sockets 31 of the connector 3 may be made plural for inserting a plurality of daughter boards 4 therein. On two opposite sides of each socket 31, a pair of metal latches 1 for the present invention are provided.

Even one preferred embodiment as shown in the drawings is a vertical type connector, in which the daughter board 4 is vertically held on the connector 3, the present invention may be modified to be an inclined type for a tilting positioning of the board 4 on the connector.

The latch 1 of the present invention may also be made of plastic material if its elasticity, strength and workability are equivalent to the metal material.

I claim:

1. An electrical connector comprising:

a longitudinal socket longitudinally formed in the connector for inserting a daughter printed circuit board therein, a plurality of contact slots transversely formed in the connector each said contact slot generally perpendicular to the longitudinal socket for embedding a spring contact element having a supporting leg member protruding downwardly from the connector to be inserted into a leg hole formed in a mother board, and two stop members formed on two opposite end portions of the connector each stop member generally parallel to the longitudinal socket, and formed with an alignment protrusion on a top portion of each stop member;

a pair of latch holding bases respectively formed on two opposite end portions of said connector; and at least two metal latches disposed on two opposite end portions of said connector, each said metal latch having its lower latch portion insertably fixed in each said latch holding base of said connector, and reciprocatively limited by two retaining plates formed on each said base on said connector for clamping the daughter board on said connector to be electrically connected with the mother board;

each said latch holding base formed on each outer end portion of the connector including: a root hole recessed in an outer end portion of the electrical connector, an outer retaining plate and an inner retaining plate respectively protruding upwardly from each holding base and disposed on an inner and an outer side of the root hole defining an aperture between the two retaining plates for reciprocatively limiting each said metal latch in said two retaining plates; and each said metal latch including: an embedding root portion formed on a lower latch portion of the metal latch, a pair of wing portions protruding outwardly from two opposite end portions of the metal latch to be generally perpendicular to a middle latch portion above the lower latch portion and slidably encompassing the outer retaining plate of said holding base, an inwardly-bent portion bending inwardly beyond the inner retaining plate of the holding base, an upper latch portion protruding upwardly from the inwardly-bent portion, a depression plate portion formed on an uppermost portion of the upper latch portion protruding outwardly upwardly from the upper latch portion, and a latching wedge portion formed on an upper portion of the upper latch portion below the depression plate portion and tapered rearwardly and inwardly for slidably guiding a daughter board to be resiliently clamped by the two metal latches and stopped by the two stop members respectively formed on two opposite end portions of the electrical connector.

2. An electrical connector according to claim 1, wherein said depression plate portion of said metal latch is formed with a crimped edge portion on an uppermost and outermost end portion of the depression plate portion adapted to be depressed by an operator's fingers.

3. An electrical connector according to claim 1, wherein said embedding root portion of said latch has a width slightly larger than a width of the lower latch portion to be engageably fixed in the root hole formed in the latch holding base.

4. An electrical connector according to claim 1, wherein said upper latch portion of the metal latch is stamped to form a spring plate member protruding outwardly from the upper latch portion to be slidably retained on the outer retaining plate of the latch holding base.

* * * * *